US010907925B2

(12) United States Patent
Shaffer et al.

(10) Patent No.: US 10,907,925 B2
(45) Date of Patent: Feb. 2, 2021

(54) CROSSBOW POWER CABLE SUPPORT

(71) Applicant: Hunter's Manufacturing Company, Inc., Suffield, OH (US)

(72) Inventors: Michael J. Shaffer, Mogadore, OH (US); Gary Smith, Jr., East Canton, OH (US); Keith Bartels, Akron, OH (US); Jacob Hout, Akron, OH (US); Phillip Bednar, Copley, OH (US); Steven Bednar, Copley, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/722,064

(22) Filed: Dec. 20, 2019

(65) Prior Publication Data

US 2020/0124376 A1 Apr. 23, 2020

Related U.S. Application Data

(63) Continuation of application No. 15/925,226, filed on Mar. 19, 2018, now Pat. No. 10,514,226.

(60) Provisional application No. 62/473,175, filed on Mar. 17, 2017.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01)

(58) Field of Classification Search
CPC ..... F41B 5/105; F41B 5/12; F41B 5/123
USPC ..... 124/25, 25.6, 900
See application file for complete search history.

(56) References Cited

U.S. PATENT DOCUMENTS

| | | | | | |
|---|---|---|---|---|---|
| 2,092,361 | A | | 9/1937 | Shim | |
| 3,043,287 | A | | 7/1962 | Nelson | |
| 3,561,419 | A | | 2/1971 | Cucuzza, Sr. | |
| 3,670,711 | A | | 6/1972 | Firestone | |
| 3,739,765 | A | | 6/1973 | Moore | |
| 3,854,467 | A | * | 12/1974 | Hofmeister | F41B 5/105 124/25.6 |
| 3,987,777 | A | * | 10/1976 | Darlington | F41B 5/10 124/25.6 |
| 4,077,385 | A | * | 3/1978 | Fredrickson | F41B 5/10 124/25.6 |
| 4,169,456 | A | * | 10/1979 | Van House | F41B 5/12 124/25 |
| 4,192,281 | A | | 3/1980 | King | |

(Continued)

OTHER PUBLICATIONS

European Crossbows, A Survey by Josef Alm, copyrighted by the Trustees of the Royal Armouries and the Arms and Armour Society, 1994.

(Continued)

*Primary Examiner* — Alexander R Niconovich
(74) *Attorney, Agent, or Firm* — Emerson Thomson Bennett, LLC

(57) ABSTRACT

A crossbow in some embodiments may include two power cables and two power cable wheels. Each power cable may extend from a bowstring wheel, to a power cable wheel and then back to the bowstring wheel. A crossbow in some other embodiments may include four power cables and two power cable wheels. Each power cable may extend from a bowstring wheel, to a power cable wheel and then to a portion of the crossbow that does not move relative to the main beam.

15 Claims, 5 Drawing Sheets

(56) References Cited

U.S. PATENT DOCUMENTS

| | | | | |
|---|---|---|---|---|
| 4,246,883 | A | 1/1981 | Ash | |
| 4,461,267 | A * | 7/1984 | Simonds | F41B 5/10 124/25.6 |
| 4,593,675 | A | 6/1986 | Waiser | |
| 4,603,676 | A | 8/1986 | Luoma | |
| 4,649,890 | A * | 3/1987 | Powers | F41B 5/105 124/25.6 |
| 4,649,891 | A * | 3/1987 | Bozek | F41B 5/123 124/25 |
| 4,649,892 | A | 3/1987 | Bozek | |
| 4,662,345 | A | 5/1987 | Stephens | |
| 4,665,885 | A | 5/1987 | Glomski et al. | |
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A * | 10/1997 | Hadley | F41B 5/12 124/24.1 |
| 5,987,724 | A | 11/1999 | Kleman | |
| 6,095,128 | A | 8/2000 | Bednar | |
| 6,286,496 | B1 | 9/2001 | Bednar | |
| 6,776,148 | B1 * | 8/2004 | Islas | F41B 5/10 124/25.6 |
| 6,792,931 | B1 * | 9/2004 | Schaar | F41B 5/10 124/25.6 |
| 6,874,491 | B2 | 4/2005 | Bednar | |
| 6,913,007 | B2 | 7/2005 | Bednar | |
| 7,100,590 | B2 | 9/2006 | Chang | |
| 7,578,289 | B2 * | 8/2009 | Norkus | F41B 5/0094 124/25 |
| 7,624,725 | B1 | 12/2009 | Choma | |
| 7,637,256 | B2 | 12/2009 | Lee | |
| 7,784,453 | B1 | 8/2010 | Yehle | |
| 7,891,348 | B2 * | 2/2011 | Colley | F41B 5/123 124/25 |
| 8,387,603 | B2 * | 3/2013 | Darlington | F41B 5/12 124/25.6 |
| 8,387,604 | B1 * | 3/2013 | Terzo | F41B 5/123 124/25.6 |
| 8,443,790 | B2 | 5/2013 | Pestrue | |
| 8,499,753 | B2 | 8/2013 | Bednar | |
| 8,651,095 | B2 * | 2/2014 | Islas | F41B 5/123 124/25 |
| 8,826,894 | B1 * | 9/2014 | Darlington | F41B 5/105 124/25.6 |
| 8,997,728 | B2 | 4/2015 | Popov | |
| 9,234,719 | B1 * | 1/2016 | Kempf | F41B 5/123 |
| 9,243,861 | B1 * | 1/2016 | Kempf | F41B 5/12 |
| 9,297,604 | B1 * | 3/2016 | Sidebottom | F41B 5/12 |
| 9,377,267 | B1 * | 6/2016 | Kempf | F41B 5/123 |
| 9,494,379 | B2 | 11/2016 | Yehle | |
| 9,513,080 | B1 * | 12/2016 | Kempf | F41B 5/1411 |
| 9,759,509 | B1 * | 9/2017 | Kempf | F41B 5/123 |
| 9,829,268 | B1 * | 11/2017 | Kempf | F41B 5/123 |
| 9,879,938 | B1 * | 1/2018 | Isenhower | F41B 5/123 |
| 9,945,634 | B1 * | 4/2018 | Isenhower | F41B 5/10 |
| 10,048,036 | B1 * | 8/2018 | Kempf | F41B 5/123 |
| 10,267,592 | B2 * | 4/2019 | Bartels | F41B 5/123 |
| 10,458,742 | B1 * | 10/2019 | Kempf | F41B 5/123 |
| 10,473,418 | B2 * | 11/2019 | Shaffer | F41B 5/123 |
| 2006/0086346 | A1 | 4/2006 | Middleton | |
| 2008/0135032 | A1 * | 6/2008 | Islas | F41B 5/105 124/90 |
| 2010/0170488 | A1 | 1/2010 | Rasor et al. | |
| 2011/0056467 | A1 * | 3/2011 | Popov | F41B 5/1469 124/25.6 |
| 2015/0285581 | A1 * | 10/2015 | Chang | F41B 5/105 124/25 |

OTHER PUBLICATIONS

The Book of the Crossbow, by Ralph Payne-Gallwey, published by Dover Publications, Inc. of New York, 1995.

A Guide to the Crossbow, by W. F. Paterson, published by the Society of Archer-Antiquaries, 1990.

* cited by examiner

CROSSBOW POWER CABLE SUPPORT

This application is a continuation of U.S. patent application Ser. No. 15/925,226, titled Crossbow Power Cable Support, filed Mar. 19, 2018, which claims priority to U.S. Patent Application No. 62/473,175, titled Crossbow Power Cord Support, filed Mar. 17, 2017, which are incorporated herein by reference.

I. BACKGROUND

A. Field of the Invention

This invention generally relates to methods and apparatuses related to crossbows and more specifically to methods and apparatuses related to crossbow cables.

B. Description of Related Art

Crossbows have been used for many years as a weapon for hunting and fishing, and for target shooting. In general, a crossbow includes a main beam that may have a stock member and a barrel connected to the stock member. The barrel typically has an arrow receiving area for receiving the arrow that is to be fired or shot. The crossbow also includes a bow assembly supported on the main beam that includes a bow (including a pair of bow limbs) and a bowstring connected to the bow for use in shooting arrows. A trigger mechanism, also supported on the main beam, holds the bowstring in a drawn or cocked condition and can thereafter be operated to release the bowstring to an uncocked condition to fire or shoot the arrow.

It is also known to provide crossbows with cables in addition to the bowstring. These cables may serve different functions and may go by various names as is well known to those of skill in the art. In this patent, all cables other than the bowstring will be identified as power cables. An ongoing issue is how best to support such power cables to the crossbow. One problem with crossbows concerns the uneven distribution of forces as the crossbow is cocked and/or fired.

Minimizing uneven force distribution is one of the objects of this invention. This invention will provide numerous other advantages as will be readily understood by a person of skill in the art.

II. SUMMARY

According to some embodiments of this invention, a crossbow may comprise a main beam that extends longitudinally and that has a longitudinal axis that defines first and second sides of the crossbow; a bow assembly supported to the main beam and comprising: a bowstring; first and second bow limbs that are positioned on the first and second sides of the crossbow, respectively; first and second bowstring wheels supported to the first and second bow limbs, respectively; first, second, third and fourth power cable portions; and first and second power cable wheels positioned on the first and second sides of the crossbow, respectively; and a trigger mechanism supported to the main beam and operable to: hold the bowstring in a cocked position; and release the bowstring from the cocked position to fire the crossbow. The first bowstring wheel may be rotatable with respect to the main beam about a first rotational axis and may comprise: a bowstring reception surface; a first power cable reception surface; and a second power cable reception surface. The second bowstring wheel may be rotatable with respect to the main beam about a second rotational axis and may comprise: a bowstring reception surface; a first power cable reception surface; and a second power cable reception surface. The first power cable wheel may comprise at least one power cable reception surface and may be rotatable with respect to the main beam about a third rotational axis. The second power cable wheel may comprise at least one power cable reception surface and may be rotatable with respect to the main beam about a fourth rotational axis. The bowstring may have a first end received on the bowstring reception surface of the first bowstring wheel and a second end received on the bowstring reception surface of the second bowstring wheel. The crossbow may define a bowstring plane on which the bowstring travels between cocked and released positions. The first power cable reception surface of the first bowstring wheel and the first power cable reception surface of the second bowstring wheel may lie on a plane defined as a first plane. The second power cable reception surface of the first bowstring wheel and the second power cable reception surface of the second bowstring wheel may lie on a plane defined as a second plane. The first and second planes may be parallel to the bowstring plane and equidistant from the bowstring plane. The first power cable portion may extend along the first plane from the first power cable reception surface of the first bowstring wheel to the at least one power cable reception surface of the first power cable wheel. The second power cable portion may extend along the first plane from the first power cable reception surface of the second bowstring wheel to the at least one power cable reception surface of the second power cable wheel. The third power cable portion may extend along the second plane from the second power cable reception surface of the first bowstring wheel to the at least one power cable reception surface of the first power cable wheel. The fourth power cable portion may extend along the second plane from the second power cable reception surface of the second bowstring wheel to the at least one power cable reception surface of the second power cable wheel. The first power cable portion may be a first end of a first cable and the third power cable portion may be a second end of the first cable. The third power cable portion may be a first end of a second cable and the fourth power cable portion may be a second end of the second cable.

According to some embodiments of this invention, a crossbow may comprise: a main beam that extends longitudinally and that has a longitudinal axis that defines first and second sides of the crossbow; a bow assembly supported to the main beam and comprising: a bowstring; first and second bow limbs that are positioned on the first and second sides of the crossbow, respectively; first and second bowstring wheels supported to the first and second bow limbs, respectively; first, second, third and fourth power cable portions; and first and second power cable wheels positioned on the first and second sides of the crossbow, respectively; and a trigger mechanism supported to the main beam and operable to: hold the bowstring in a cocked position; and release the bowstring from the cocked position to fire the crossbow. The first bowstring wheel may be rotatable with respect to the main beam about a first rotational axis and may comprise: a bowstring reception surface; a first power cable reception surface; and a second power cable reception surface. The second bowstring wheel may be rotatable with respect to the main beam about a second rotational axis and may comprise: a bowstring reception surface; a first power cable reception surface; and a second power cable reception surface. The first power cable wheel may comprise at least one power cable reception surface and may be rotatable with respect to the main beam about a third rotational axis. The second power cable wheel may comprise at least one power cable reception surface and may be rotatable with respect to the main beam about a fourth rotational axis. The bowstring may have a first end received on the bowstring reception surface of the first bowstring wheel and a second end received on the bowstring reception surface of the second bowstring wheel. The crossbow may define a bowstring plane on which the bowstring travels between cocked and released positions. The first power cable reception surface of the first bowstring wheel and the first power cable reception surface of the second bowstring wheel may lie on a plane defined as a first plane. The second power cable reception surface of the first bowstring wheel and the second power cable reception surface of the second bowstring wheel may lie on a plane defined as a second plane. The first and second planes may be parallel to the bowstring plane and equidistant from the bowstring plane. The first power cable portion may extend along the first plane from the first power cable reception surface of the first bowstring wheel to the at least one power cable reception surface of the first power cable wheel. The second power cable portion may extend along the first plane from the first power cable reception surface of the second bowstring wheel to the at least one power cable reception surface of the second power cable wheel. The third power cable portion may extend along the second plane from the second power cable reception surface of the first bowstring wheel to the at least one power cable reception surface of the first power cable wheel. The fourth power cable portion may extend along the second plane from the second power cable reception surface of the second bowstring wheel to the at least one power cable reception surface of the second power cable wheel. A fifth power cable portion may extend along one of the first and second planes from the at least one power cable reception surface of the first power cable wheel to a portion of the crossbow where it may be fixed. A sixth power cable portion may extend along one of the first and second planes from the at least one power cable reception surface of the second power cable wheel to a portion of the crossbow where it may be fixed.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DEFINITIONS

The following definitions are controlling for the disclosed inventions:

"Arrow" means a projectile that is shot with (or fired by or launched by) a bow assembly.

"Bow" means a bent, curved, or arched object. A bow includes a pair of bow limbs.

"Bow Assembly" means a weapon comprising a bow and a bowstring that shoots (or fires or propels) arrows powered by the elasticity of the bow and the drawn bowstring.

"Bowstring" means a string or cable attached to a bow and used to shoot (or fire or propel) arrows.

"Compound Bow" means a bow that has wheels, pulleys or cams at each end of the bow through which the bowstring passes. A compound bow may include strings or cables in addition to the bowstring that interconnect the wheels, pulleys or cams to each other and/or to other portions of the bow. Other types of bows may also use strings or cables in addition to the bowstring.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. A main beam can be includes a stock member and a barrel. Sometimes a barrel is a distinct component from the stock member that is attached to the stock member. Other times the barrel and stock member comprise a single component.

"Physically coupled," as applied to strings and cables, means two or more strings/cables that are physically linked together. This can be accomplished in many ways including strings/cables that are formed together as a single piece, strings/cables that are fastened, joined, affixed or otherwise physically bonded together, and strings/cables that are physically connected using hooks, clips and the like. Strings/cables are not physically coupled simply because they work together on a bow assembly and/or simply because they are both received on the same wheel, cam or the like.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

V. DETAILED DESCRIPTION

Figure 1:
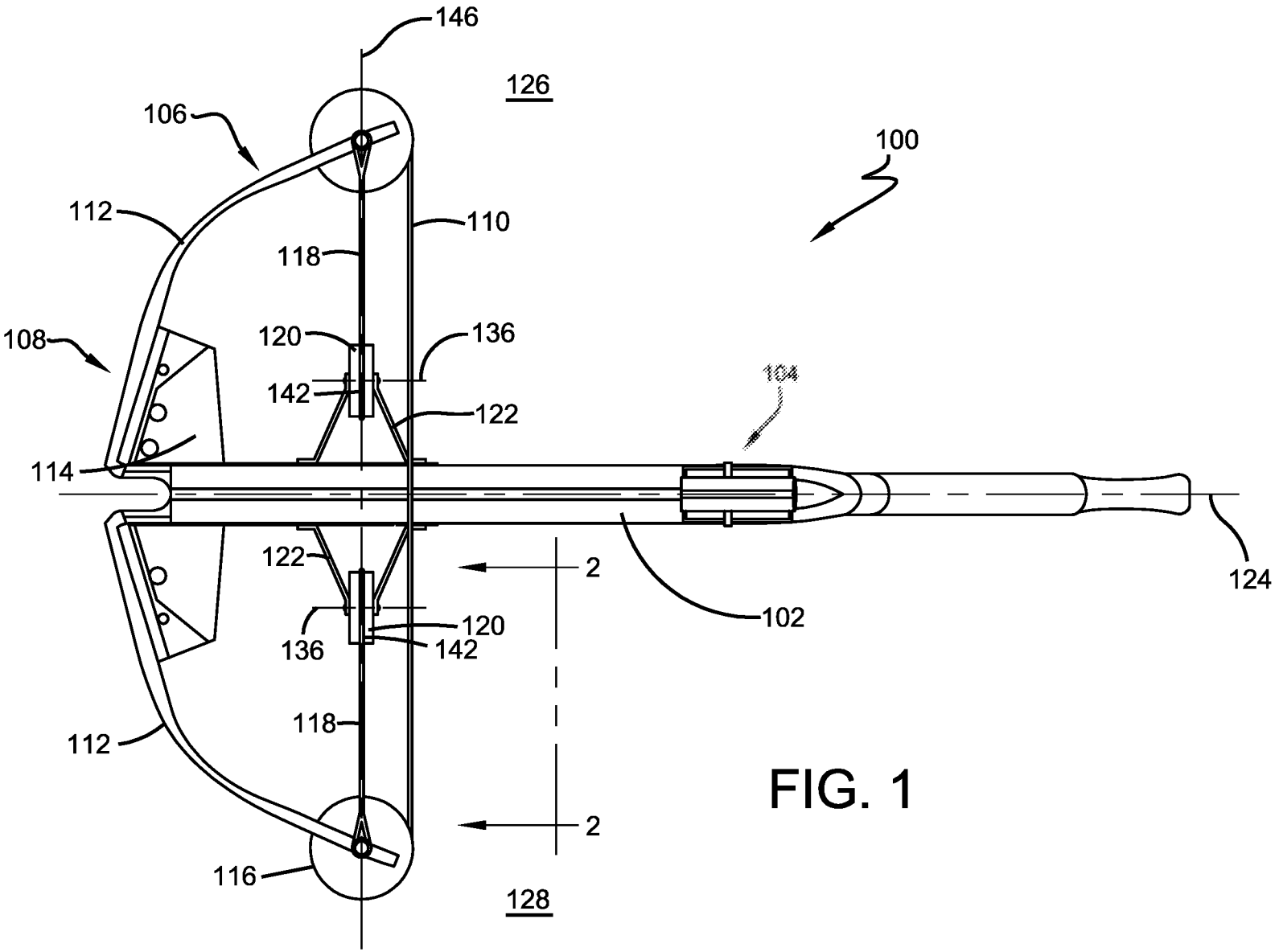
FIG. 1 is a schematic top view of a crossbow.

Referring now to the drawings wherein the showings are for purposes of illustrating embodiments of the invention only and not for purposes of limiting the same, and wherein like reference numerals are understood to refer to like components, FIG. 1 shows some aspects of the present teaching with a crossbow 100 that may include a main beam 102 and a trigger mechanism 104 suitable for shooting an arrow (not shown). The main beam 102 may extend longitudinally and have a longitudinal axis 124 that defines first and second sides 126, 128 of the crossbow. The trigger mechanism 104 may be mounted to the main beam 102 in any suitable manner. The trigger mechanism 104 may be operable to hold a bowstring 110 in a cocked position and release the bowstring 110 from the cocked position to fire the crossbow 100. Because the operation of trigger mechanisms are well known to those of skill in the art, no details will be provided here.

With continuing reference to FIG. 1, the crossbow 100 may include a bow assembly 106 supported to the main beam 102 and adapted to propel an arrow (not shown). The bow assembly 106 may be supported directly to the main beam 102 or may be, in the embodiment shown, supported to the main beam 102 via a riser 114. The bow assembly 106 may include a bow 108, having a pair of bow limbs 112, 112, and a bowstring 110. The bow limbs 112, 112 may be flexible, in some embodiments. The riser 114 may interconnect the bow limbs 112, 112 to the main beam 102, as shown. One bow limb 112 may be positioned on the first side 126 of the crossbow and the other bow limb 112 may be positioned on the opposite side 128, as shown. While the crossbow shown uses a compound bow, it should be understood that this invention will work well with any type of bow chosen with sound judgment by a person of ordinary skill in the art.

Figure 2:
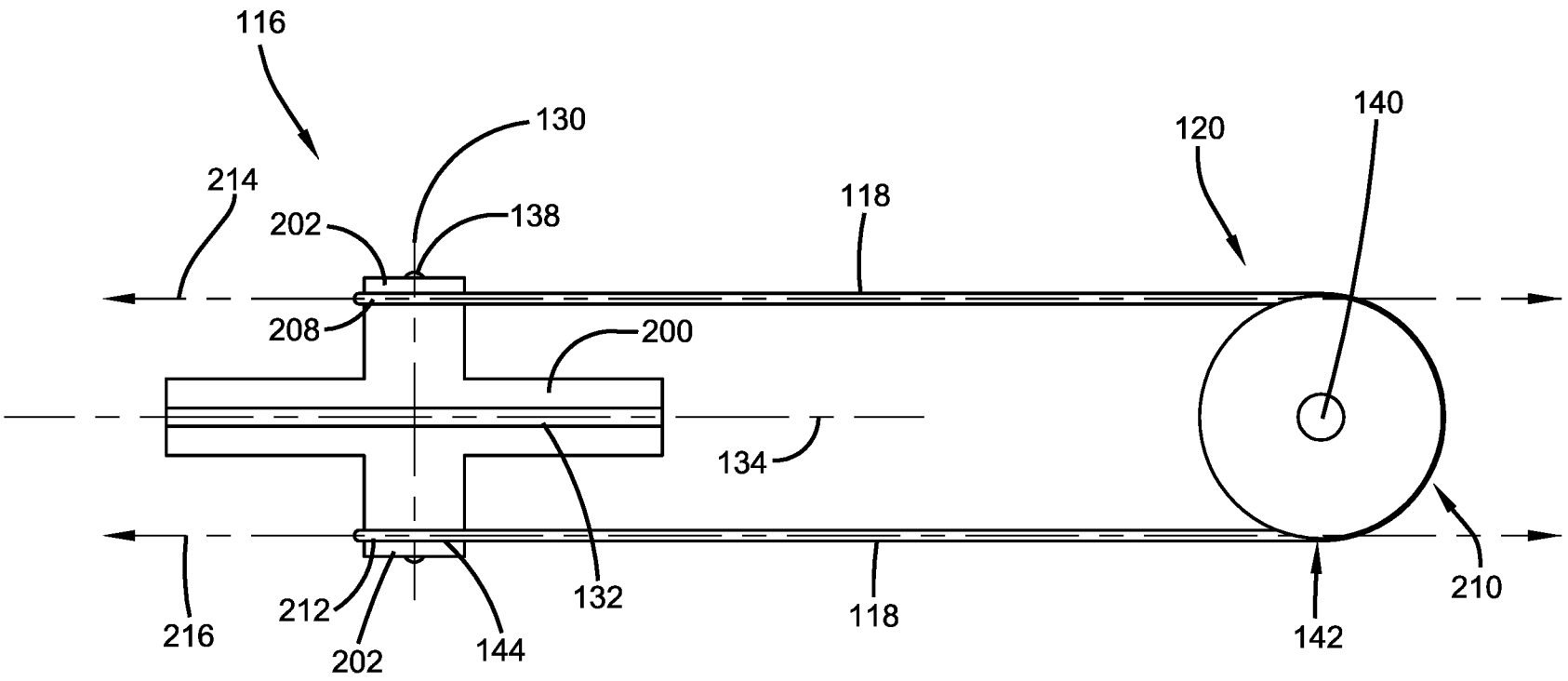
FIG. 2 is a view along line 2-2 of FIG. 1 with some components removed for clarity.

With reference now to FIGS. 1-2, the bow limbs 112, 112 may receive the bowstring 110 in any conventional manner chosen with the sound judgment of a person of ordinary skill in the art. For the embodiment shown, a pair of bowstring wheels (which may be pulleys, cams, or the like) 116, 116 are rotatably mounted to the bow limbs 112, 112. Each wheel 116 may rotate with respect to the main beam 102 about a rotational axis 130, as shown. The rotational axis 130 may be defined by an axle or pin 138 that the wheel 116 rotates around. Each bowstring wheel 116 may have a bowstring reception surface 132 to which the bowstring 110 is received. For the embodiment shown, the bowstring reception surface 132 is a groove. One end of the bowstring 110 may be received on the bowstring reception surface 132 of the bowstring wheel 116 on the first side 126 of the crossbow 100 and the opposite end of the bowstring 110 may be received on the bowstring reception surface 132 of the bowstring wheel 116 on the second side 128. The bowstring 110 may be unwrapped from the bowstring wheels 116, 116 to cock the crossbow 100 and wrapped onto the bowstring wheels 116, 116 to fire the crossbow 100 as is well known by those of skill in the art. The crossbow 100 thus defines a bowstring plane 134, indicated in FIG. 2, on which the bowstring 110 travels between cocked and released positions, as is also well known by those of skill in the art. The first side 126 of the crossbow 100 may be a mirror image of the second side 128.

For the embodiment shown in FIGS. 1-2, two power cables 118, 118 and two power cable wheels (which may be pulleys, cams, or the like) 120, 120 are used. One power cable wheel 120 may be positioned on the first side 126 of the crossbow 100 and the other cable wheel 120 may be positioned on the opposite side 128, as shown. Each wheel 120 may rotate with respect to the main beam 102 about a rotational axis 136, as shown. The rotational axis 136 may be defined by an axle or pin 140 that the wheel 120 rotates around. In some embodiments, support brackets 122 support each wheel 120 to the main beam 102. Each power cable wheel 120 may have a power cable reception surface 142 to which the corresponding power cable 118 is received. For the embodiment shown, the power cable reception surface 142 is a groove.

With continuing reference now to FIGS. 1-2, each bowstring wheel 116 may have a pair of power cable reception surfaces 144, 144 to which the corresponding power cable 118 is received. For the embodiment shown, each power cable reception surface 144 is a groove. The bowstring reception surface 132 and power cable reception surfaces 144, 144 may be oriented in any manner chosen with the sound judgment of a person of skill in the art. For the embodiment shown, the bowstring reception surface 132 is positioned on a mid-portion 200 of the wheel 116 and the power cable reception surfaces 144, 144 are positioned on upper and lower portions 202, 202 of the wheel 116. In one embodiment, each cable reception surface 144 is equidistant from the bowstring reception surface 132. Each power cable 118 may have a first end 208 received on one power cable reception surface 144 of the bowstring wheel 116, a mid-portion 210 received on the power cable reception surface 142 of the corresponding power cable wheel 120 and a second end 212 received on the other power cable reception surface 144 of the bowstring wheel 116, as shown.

Still referring to FIGS. 1-2, the orientation of each wheel 116 rotational axis 130 and each wheel 120 rotational axis 136 may be any chosen with the sound judgment of a person of skill in the art. In one embodiment, shown, the rotational axes 136, 136 are perpendicular with respect to the rotational axes 130, 130, or nearly so. To visualize this, note that the main beam longitudinal axis 124 is parallel to the bowstring plane 134 (it may, or may not, lie on the bowstring plane 134). A plane that is perpendicular to the bowstring plane 134 and upon which the longitudinal axis 124 lies is defined as a first plane. (Reference 124 in FIG. 1 can also represent the first plane since the first plane would appear only as a line in FIG. 1.) The rotational axes 136, 136 of each power cable wheel 116 may be, in one embodiment, perpendicular to the first plane 124, as shown. In another embodiment, each rotational axis 136 forms an acute angle with the first plane 124 that is 30 degrees or less. In another embodiment, each rotational axis 136 forms an acute angle with the first plane 124 that is 15 degrees or less.

For the embodiments shown in FIGS. 1-2, all of one power cable 118 is positioned on the first side 126 of the crossbow 100 when the crossbow 100 is cocked and when the crossbow 100 is fired while all of the other power cable 118 is positioned on the second side 128 of the crossbow 100 when the crossbow 100 is cocked and when the crossbow 100 is fired. Also for the embodiments shown, the bowstring 110 is not physically coupled to either of the power cables 118, 118 and the power cables 118, 118 are not physically coupled to each other.

With continuing reference to FIGS. 1-2, for the embodiments shown, the power cables 118, 118 lie on a plane 146 defined as a power cable plane. Relatively small portions of each cable 118 may not lie on power cable plane 146 due to cable tie-offs and the like. Thus, at least most of each power cable 118, 118 may lie on power cable plane 146. In another embodiment, power cable plane 146 is perpendicular to the bowstring plane 134. In another embodiment, the power cable plane 146 forms an acute angle with the bowstring plane 134 that is 30 degrees or less. In another embodiment, the power cable plane 146 forms an acute angle with the bowstring plane 134 that is 15 degrees or less.

Still referring to FIGS. 1-2, in some embodiments, each power cable 118 extends between one power cable reception surface 144 of the bowstring wheel 116 and the power cable wheel 120 on a first line 214 and extends between the other power cable reception surface 144 of the bowstring wheel 116 and the power cable wheel 120 on a second line 216. In some embodiments, shown, the first line 214 lies on a plane (also represented by reference 214) that is parallel to the bowstring plane 134 and the second line 216 lies on a plane (also represented by reference 216) that is parallel to the bowstring plane 134. In some embodiments, the planes 214, 216 are equidistance from the bowstring plane 134. This may provide smooth operation without the addition of unwanted forces that may wear components excessively. In some embodiments the two upper planes 214, 214 (as shown in FIG. 2), one on each side of the crossbow 100, are coplanar and the two lower planes 216, 216 (as shown in FIG. 2), one on each side of the crossbow 100, are coplanar.

Figure 3:
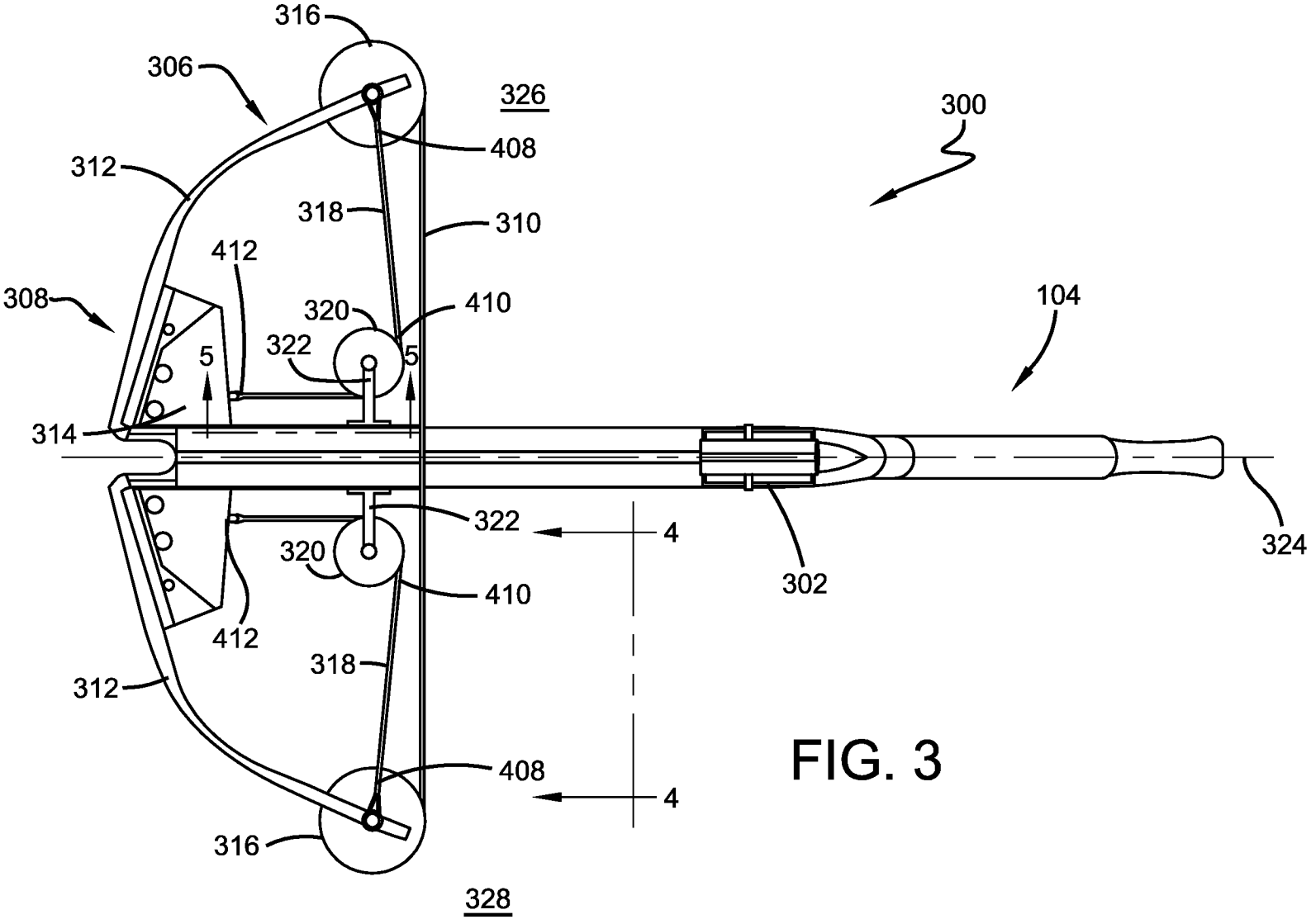
FIG. 3 is a schematic top view of a crossbow.

FIG. 3 shows some aspects of the present teaching with a crossbow 300 that may include a main beam 302 and a trigger mechanism 304 suitable for shooting an arrow (not shown). The main beam 302 may extend longitudinally and have a longitudinal axis 324 that defines first and second sides 326, 328 of the crossbow. The trigger mechanism 304 may be mounted to the main beam 302 in any suitable manner. The trigger mechanism 304 may be operable to hold a bowstring 310 in a cocked position and release the bowstring 310 from the cocked position to fire the crossbow 300. Because the operation of trigger mechanisms are well known to those of skill in the art, no details will be provided here.

With continuing reference to FIG. 3, the crossbow 300 may include a bow assembly 306 supported to the main beam 302 and adapted to propel an arrow (not shown). The bow assembly 303 may be supported directly to the main beam 302 or may be, in the embodiment shown, supported to the main beam 302 via a riser 314. The bow assembly 303 may include a bow 308, having a pair of bow limbs 312, 312, and a bowstring 310. The bow limbs 312, 312 may be flexible, in some embodiments. The riser 314 may interconnect the bow limbs 312, 312 to the main beam 302, as shown. One bow limb 312 may be positioned on the first side 326 of the crossbow and the other bow limb 312 may be positioned on the opposite side 328, as shown. While the crossbow shown uses a compound bow, it should be understood that this invention will work well with any type of bow chosen with sound judgment by a person of ordinary skill in the art.

Figure 4:
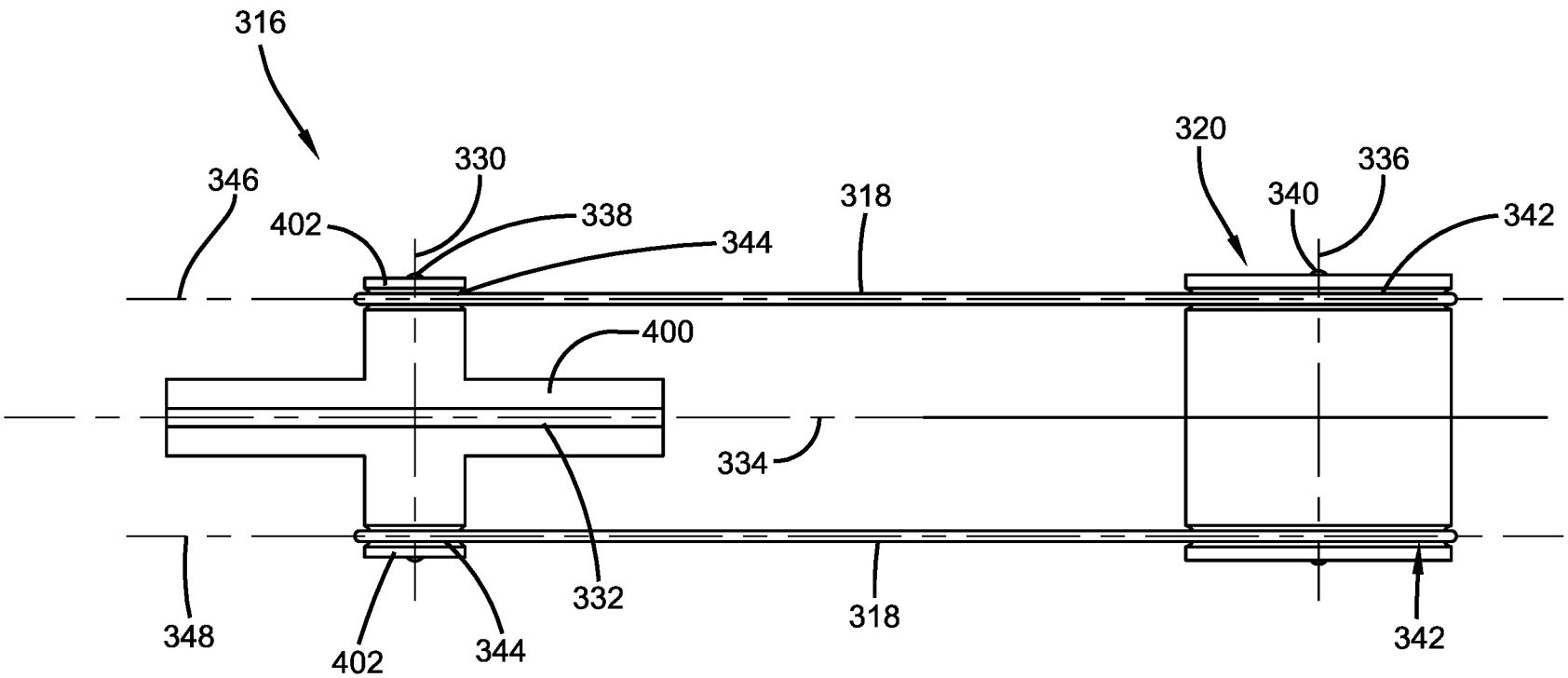
FIG. 4 is a view along line 4-4 of FIG. 3 with some components removed for clarity.
Figure 5:
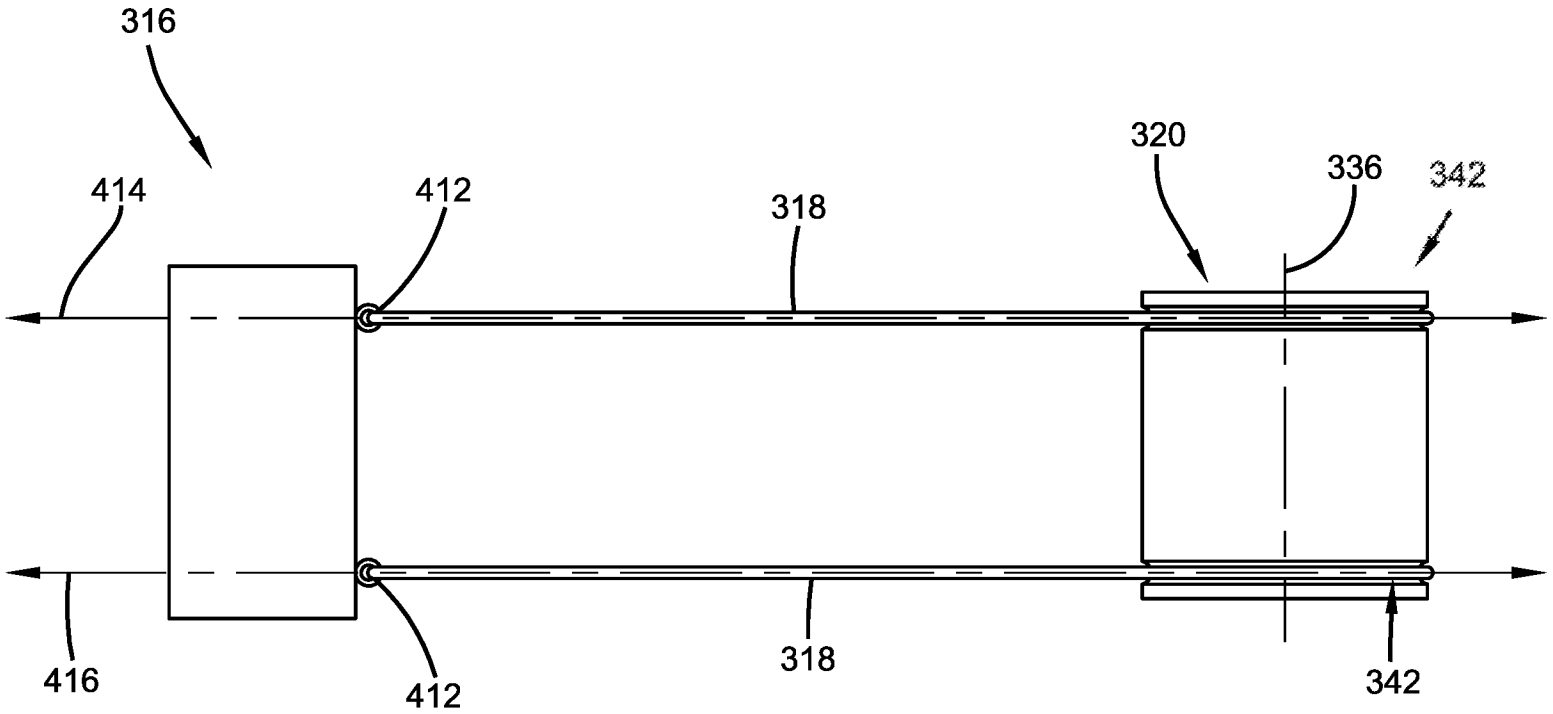
FIG. 5 is a view along line 5-5 of FIG. 3 with some components removed for clarity.

With reference now to FIGS. 3-5, the bow limbs 312, 312 may receive the bowstring 310 in any conventional manner chosen with the sound judgment of a person of ordinary skill in the art. For the embodiment shown, a pair of bowstring wheels (which may be pulleys, cams, or the like) 316, 316 are rotatably mounted to the bow limbs 312, 312. Each wheel 316 may rotate with respect to the main beam 302 about a rotational axis 330, as shown. The rotational axis 330 may be defined by an axle or pin 338 that the wheel 316 rotates around. Each bowstring wheel 316 may have a bowstring reception surface 332 to which the bowstring 310 is received. For the embodiment shown, the bowstring reception surface 332 is a groove. One end of the bowstring 310 may be received on the bowstring reception surface 332 of the bowstring wheel 316 on the first side 326 of the crossbow 300 and the opposite end of the bowstring 310 may be received on the bowstring reception surface 332 of the bowstring wheel 316 on the second side 328. The bowstring 310 may be unwrapped from the bowstring wheels 316, 316 to cock the crossbow 300 and wrapped onto the bowstring wheels 316, 316 to fire the crossbow 300 as is well known by those of skill in the art. The crossbow 300 thus defines a bowstring plane 334, indicated in FIG. 4, on which the bowstring 310 travels between cocked and released positions, as is also well known by those of skill in the art. The first side 326 of the crossbow 300 may be a mirror image of the second side 328.

For the embodiment shown in FIGS. 3-5, four power cables 318, 318, 318, 318 and two power cable wheels (which may be pulleys, cams, or the like) 320, 320 are used. One power cable wheel 320 may be positioned on the first side 326 of the crossbow 300 and the other cable wheel 320 may be positioned on the opposite side 328, as shown. Each wheel 320 may rotate with respect to the main beam 302 about a rotational axis 336, as shown. The rotational axis 336 may be defined by an axle or pin 340 that the wheel 320 rotates around. In some embodiments, support brackets 322 support each wheel 320 to the main beam 302. Each power cable wheel 320 may have a pair of power cable reception surfaces 342, 342 to which the corresponding power cable 318 is received. For the embodiment shown, each power cable reception surface 342 is a groove.

With continuing reference to FIGS. 3-5, each bowstring wheel 316 may have a pair of power cable reception surfaces 344, 344 to which the corresponding power cable 318 is received. For the embodiment shown, each power cable reception surface 344 is a groove. The bowstring reception surface 332 and power cable reception surfaces 344, 344 may be oriented in any manner chosen with the sound judgment of a person of skill in the art. For the embodiment shown, the bowstring reception surface 332 is positioned on a mid-portion 400 of the wheel 316 and the power cable reception surfaces 344, 344 are positioned on upper and lower portions 402, 402 of the wheel 316. In one embodiment, each cable reception surface 344 is equidistant from the bowstring reception surface 332. Each power cable 318 may have a first end 408 received on one power cable reception surface 344 of the bowstring wheel 316, a mid-portion 410 received on one power cable reception surface 342 of the corresponding power cable wheel 320 and a second end 412 attached to a portion of the crossbow 300 that does not move relative to the main beam 302 when the crossbow 300 is cocked and when the crossbow 300 is fired. For the embodiments shown in FIGS. 3-4, all of two of the power cables 318, 318 are positioned on the first side 326 of the crossbow 300 when the crossbow 300 is cocked and when the crossbow 300 is fired while the other two of the power cables 318, 318 are positioned on the second side 328 of the crossbow 300 when the crossbow 300 is cocked and when the crossbow 300 is fired. For the embodiments shown, the bowstring 310 is not physically coupled to any of the power cables 318. In other embodiments, also shown, none of the power cables 318 are physically coupled to any of the other power cables 318.

Still referring to FIGS. 3-5, the orientation of each wheel 316 rotational axis 330 and each wheel 320 rotational axis 336 may be any chosen with the sound judgment of a person of skill in the art. In one embodiment, shown, the rotational axes 336, 336 are parallel with respect to the rotational axes 330, 330, or nearly so. In some embodiments, shown, the second end 412 of each power cable 318 is attached to a portion of the riser 314. In another embodiment, the second end 412 of each power cable 318 is fixed to a portion of the riser 314. In yet another embodiment, the second ends 412, 412, 412, 412 of the power cables 318, 318, 318, 318 are attached, fixed or otherwise, to distinct portions of the riser 314.

With continuing reference to FIGS. 3-5, each power cable 318 may have a first end 408 received on one power cable reception surface 344 of the bowstring wheel 316, a mid-portion 410 received on one power cable reception surface 342 of the corresponding power cable wheel 320 and a second end 412 attached to a portion of the crossbow 300 that does not move relative to the main beam 302 when the crossbow 300 is cocked and when the crossbow 300 is fired. For the embodiments shown, the upper power cables 318, 318 (as shown in FIG. 4), one on each side of the crossbow, lie on a plane 346 defined as a first power cable plane and the lower power cables 318, 318 (as shown in FIG. 4), one on each side of the crossbow, lie on a plane 348 defined as a second power cable plane. Relatively small portions of each cable 318 may not lie on power cable plane 346 or 348 due to cable tie-offs and the like. Thus, at least most of each power cable 318 may lie on power cable plane 346 or 348.

In the same way, at least most of the bowstring 310 may lie on the bowstring plane 334. In one embodiment, shown, the power cable planes 346, 348 and bowstring plane 334 are parallel.

With continuing reference to FIGS. 3-5, note that the main beam longitudinal axis 324 is parallel to the bowstring plane 334 (it may, or may not, lie on the bowstring plane 334). A plane that is perpendicular to the bowstring plane 334 and upon which the longitudinal axis 324 lies is defined as a first plane. (Reference 324 in FIG. 3 can also represent the first plane since the first plane would appear only as a line in FIG. 3.) In other embodiments, each upper power cable 318, one on each side of the crossbow 300, extends between one power cable reception surface 342 of the power cable wheel 320 and the second end 412 of the power cable 318 on a first line 414. Similarly, each lower power cable 318, one on each side of the crossbow 300, may extend between one power cable reception surface 342 of the power cable wheel 320 and the second end 412 of the power cable 318 on a second line 416. In some embodiments, each of the lines 414, 414, 416, 416 is parallel to the first plane 324. In another embodiment, each of the lines 414, 414, 416, 416 forms an acute angle with the first plane 324 that is 30 degrees or less. In another embodiment, each of the lines 414, 414, 416, 416 forms an acute angle with the first plane 324 that is 15 degrees or less.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved

Having thus described the invention, it is now claimed:

We claim:

1. A crossbow, comprising:

a main beam that extends longitudinally and that has a longitudinal axis that defines first and second sides of the crossbow;

a bow assembly supported to the main beam and comprising: a bowstring; first and second bow limbs that are positioned on the first and second sides of the crossbow, respectively;

first and second bowstring wheels supported to the first and second bow limbs, respectively;

first, second, third and fourth power cable portions; and first and second power cable wheels positioned on the first and second sides of the crossbow, respectively; and a trigger mechanism supported to the main beam and operable to: hold the bowstring in a cocked position; and release the bowstring from the cocked position to fire the crossbow;

wherein:

(1) the first bowstring wheel is rotatable with respect to the main beam about a first rotational axis and comprises: a bowstring reception surface; a first power cable reception surface; and a second power cable reception surface;

(2) the second bowstring wheel is rotatable with respect to the main beam about a second rotational axis and comprises: a bowstring reception surface; a first power cable reception surface; and a second power cable reception surface;

(3) the first power cable wheel comprises at least one power cable reception surface and is rotatable with respect to the main beam about a third rotational axis;

(4) the second power cable wheel comprises at least one power cable reception surface and is rotatable with respect to the main beam about a fourth rotational axis;

(5) the bowstring has a first end received on the bowstring reception surface of the first bowstring wheel and a second end received on the bowstring reception surface of the second bowstring wheel;

(6) the crossbow defines a bowstring plane on which the bowstring travels between cocked and released positions;

(7) the first power cable reception surface of the first bowstring wheel and the first power cable reception surface of the second bowstring wheel lie on a plane defined as a first plane distinct from the bowstring plane;

(8) the second power cable reception surface of the first bowstring wheel and the second power cable reception surface of the second bowstring wheel lie on a plane defined as a second plane distinct from the first plane and the bowstring plane;

(9) the first and second planes are parallel to the bowstring plane ;

(10) the first power cable portion extends along the first plane from the first power cable reception surface of the first bowstring wheel to the at least one power cable reception surface of the first power cable wheel;

(11) the second power cable portion extends along the first plane from the first power cable reception surface of the second bowstring wheel to the at least one power cable reception surface of the second power cable wheel;

(12) the third power cable portion extends along the second plane from the second power cable reception surface of the first bowstring wheel to the at least one power cable reception surface of the first power cable wheel;

(13) the fourth power cable portion extends along the second plane from the second power cable reception surface of the second bowstring wheel to the at least one power cable reception surface of the second power cable wheel; and

(14) one of:

A) the first power cable portion is a first end of a first cable and the third power cable portion is a second end of the first cable; and the second power cable portion is a first end of a second cable and the fourth power cable portion is a second end of the second cable; and B) a fifth power cable portion extends along one of the first and second planes from the at least one power cable reception surface of the first power cable wheel to a portion of the crossbow where it is fixed; and a sixth power cable portion extends along one of the first and second planes from the at least one power cable reception surface of the second power cable wheel to a portion of the crossbow where it is fixed.

2. The crossbow of claim 1 wherein:

each of the bowstring reception surfaces and power cable reception surfaces comprise a groove formed in the corresponding wheel.

3. The crossbow of claim 1 wherein:

a first bracket supports the first power cable wheel to the first side of the main beam; and a second bracket supports the second power cable wheel to the second side of the main beam.

4. The crossbow of claim 1 wherein:

the first power cable portion is a first end of a first cable and the third power cable portion is a second end of the first cable; and the second power cable portion is a first end of a second cable and the fourth power cable portion is a second end of the second cable.

5. The crossbow of claim 4 wherein:

the first rotational axis is perpendicular to the third rotational axis; and the second rotational axis is perpendicular to the fourth rotational axis.

6. The crossbow of claim 4 wherein:

at least most of the first, second, third and fourth power cable portions lie on a plane that is perpendicular to the bowstring plane.

7. The crossbow of claim 1 wherein:

a fifth power cable portion extends along one of the first and second planes from the at least one power cable reception surface of the first power cable wheel to a portion of the crossbow where it is fixed; and a sixth power cable portion extends along one of the first and second planes from the at least one power cable reception surface of the second power cable wheel to a portion of the crossbow where it is fixed.

8. The crossbow of claim 7 wherein:

the first rotational axis is parallel to the third rotational axis; and the second rotational axis is parallel to the fourth rotational axis.

9. The crossbow of claim 7 wherein:

the first power cable wheel has first and second power cable reception surfaces;

the second power cable wheel has first and second power cable reception surfaces;

the first power cable portion extends from the first power cable reception surface of the first bowstring wheel to the first power cable reception surface of the first power cable wheel;

the second power cable portion extends from the first power cable reception surface of the second bowstring wheel to the first power cable reception surface of the second power cable wheel;

the third power cable portion extends from the second power cable reception surface of the first bowstring wheel to the second power cable reception surface of the first power cable wheel; and the fourth power cable portion extends from the second power cable reception surface of the second bowstring wheel to the second power cable reception surface of the second power cable wheel.

10. The crossbow of claim 7 wherein:

the fifth power cable portion extends along the first plane from the at least one power cable reception surface of the first power cable wheel to a first portion of the crossbow where it is fixed;

the sixth power cable portion extends along the first plane from the at least one power cable reception surface of the second power cable wheel to a second portion of the crossbow where it is fixed;

a seventh power cable portion extends along the second plane from the at least one power cable reception surface of the first power cable wheel to a third portion of the crossbow where it is fixed; and an eighth power cable portion extends along the second plane from the at least one power cable reception surface of the second power cable wheel to a fourth portion of the crossbow where it is fixed.

11. The crossbow of claim 10 wherein:

the crossbow has a riser to which the first and second bow limbs attach; and the first, second, third and fourth portions of the crossbow are distinct portions of the riser.

12. The crossbow of claim 11 wherein:

the first and third portions are positioned on the first side of the crossbow; and the second and fourth portions are positioned on the second side of the crossbow.

13. The crossbow of claim 10 wherein:

the first power cable wheel has first and second power cable reception surfaces;

the second power cable wheel has first and second power cable reception surfaces;

the first power cable portion extends from the first power cable reception surface of the first bowstring wheel to the first power cable reception surface of the first power cable wheel;

the second power cable portion extends from the first power cable reception surface of the second bowstring wheel to the first power cable reception surface of the second power cable wheel;

the third power cable portion extends from the second power cable reception surface of the first bowstring wheel to the second power cable reception surface of the first power cable wheel;

the fourth power cable portion extends from the second power cable reception surface of the second bowstring wheel to the second power cable reception surface of the second power cable wheel;

the fifth power cable portion extends from the first power cable reception surface of the first power cable wheel to the first portion of the crossbow;

the sixth power cable portion extends from the first power cable reception surface of the second power cable wheel to the second portion of the crossbow;

the seventh power cable portion extends from the second power cable reception surface of the first power cable wheel to the third portion of the crossbow; and the eighth power cable portion extends from the second power cable reception surface of the second power cable wheel to the fourth portion of the crossbow.

14. The crossbow of claim 13 wherein:

the first power cable portion is a first end of a first cable and the fifth power cable portion is a second end of the first cable;

the second power cable portion is a first end of a second cable and the sixth power cable portion is a second end of the second cable;

the third power cable portion is a first end of a third cable and the seventh power cable portion is a second end of the third cable; and the fourth power cable portion is a first end of a fourth cable and the eighth power cable portion is a second end of the fourth cable.

15. The crossbow of claim 1 wherein:

the first and second planes are equidistant from the bowstring plane.

* * * * *